US008408684B2

(12) United States Patent
Lecheheb et al.

(10) Patent No.: US 8,408,684 B2
(45) Date of Patent: Apr. 2, 2013

(54) INK JET MODULE

(75) Inventors: Ammar Lecheheb, Cambridge (GB); Jerzy Zaba, Cambridge (GB); Matthew Tomlin, Cambridge (GB); Ian Fost, Cambs (GB)

(73) Assignee: Videojet Technologies Inc.

( * ) Notice: Subject to any disclaimer, the term of this patent is extended or adjusted under 35 U.S.C. 154(b) by 197 days.

(21) Appl. No.: 12/681,042

(22) PCT Filed: Oct. 10, 2008

(86) PCT No.: PCT/US2008/079508

§ 371 (c)(1),
(2), (4) Date: Mar. 31, 2010

(87) PCT Pub. No.: WO2009/049150

PCT Pub. Date: Apr. 16, 2009

(65) Prior Publication Data

US 2010/0220149 A1 Sep. 2, 2010

Related U.S. Application Data

(60) Provisional application No. 61/081,283, filed on Jul. 16, 2008.

(30) Foreign Application Priority Data

Oct. 12, 2007 (GB) ..... 0720140.3
Oct. 15, 2007 (GB) ..... 0720051.2

(51) Int. Cl.
*B41J 2/17* (2006.01)
*B41J 2/175* (2006.01)

(52) U.S. Cl. ..... 347/84; 347/85; 347/93

(58) Field of Classification Search ..... None
See application file for complete search history.

(56) References Cited

U.S. PATENT DOCUMENTS 4,825,228 A * 4/1989 Gloeckler et al. ..... 347/7
4,862,192 A * 8/1989 Slomianny ..... 347/7
5,030,973 A 7/1991 Nonoyama
5,742,314 A 4/1998 Hayes
(Continued)

FOREIGN PATENT DOCUMENTS

EP 0813974 12/1997
JP 57205158 12/1982
(Continued)

OTHER PUBLICATIONS

Translation of Japan Patent Office, Notification of Reason for Rejection, Japanese Patent Application No. 2010-529078, dispatched on Mar. 15, 2012.

*Primary Examiner* — Matthew Luu
*Assistant Examiner* — Renee I Wilson
(74) *Attorney, Agent, or Firm* — Joseph A. Yosick

(57) ABSTRACT

A core module for an ink jet printer includes a housing and a connection manifold disposed on the housing and including a plurality of ports providing fluid communication into and out of the module. A plurality of components is disposed within the housing, including a filter module, an ink reservoir, and an ink circuit. The filter module includes a fluid filter disposed in a filter housing. The filter housing has an inlet and an outlet. The ink circuit is in fluid communication with the components and the ports, and includes fluid paths for conveying ink between the components. The filter module is connected to the connection manifold such that the filter housing inlet and outlet are each in fluid communication with one of the plurality of ports on the manifold.

23 Claims, 13 Drawing Sheets

U.S. PATENT DOCUMENTS

| | | | | |
|---|---|---|---|---|
| 6,145,954 | A | 11/2000 | Moore | |
| 6,244,698 | B1 | 6/2001 | Chino | |
| 6,257,699 | B1 | 7/2001 | Tracy | |
| 6,273,103 | B1 | 8/2001 | Enz | |
| 6,352,324 | B1 | 3/2002 | Pagnon | |
| 6,655,791 | B1 | 12/2003 | Crockett | |
| 7,055,931 | B2 * | 6/2006 | West et al. | 347/28 |
| 7,114,794 | B2 | 10/2006 | Silverbrook | |
| 7,364,285 | B2 | 4/2008 | Murad | |
| 7,425,060 | B2 | 9/2008 | Kitahara | |
| 2002/0001025 | A1 | 1/2002 | Galan | |
| 2002/0101487 | A1 | 8/2002 | Petersen | |
| 2003/0189624 | A1 | 10/2003 | Rehman | |
| 2003/0234845 | A1 | 12/2003 | Tominaga | |
| 2004/0017447 | A1 | 1/2004 | Suzuki | |
| 2005/0151801 | A1 | 7/2005 | Neese | |
| 2006/0227190 | A1 | 10/2006 | Ishizawa | |
| 2007/0188563 | A1 | 8/2007 | Takahashi | |
| 2007/0222834 | A1 * | 9/2007 | Seshimo et al. | 347/85 |
| 2007/0263053 | A1 | 11/2007 | Imai | |

FOREIGN PATENT DOCUMENTS

| | | |
|---|---|---|
| JP | 6099586 | 12/1994 |
| JP | 11028823 | 11/1999 |
| JP | 2000225713 | 8/2000 |
| JP | 2003220713 | 8/2003 |
| JP | 2004322509 | 11/2004 |
| JP | 2007152884 | 6/2007 |
| JP | 2007190727 | 8/2007 |
| JP | 2007190728 | 8/2007 |

* cited by examiner

INK JET MODULE

RELATED APPLICATIONS

This application claims priority under 35 U.S.C. §371 from PCT Application No. PCT/US2008/079508, filed in English on Oct. 10, 2008, which claims the benefit of: Great Britain Application Serial No. 0720140.3 filed on Oct. 12, 2007, Great Britain Application Serial No. 0720051.2 filed on Oct. 15, 2007, and U.S. Application Ser. No. 61/081,283, filed on Jul. 16, 2008, the disclosures of all of which are incorporated by reference herein in their entireties The present disclosure relates to ink jet printing and more particularly to core module for an ink supply system for an ink jet printer such as a continuous ink jet printer.

BACKGROUND

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix including a regular array of potential drop positions. Each matrix comprises a plurality of columns (strokes), each being defined by a line including a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this, "make-up" solvent is added to the ink as required from a replaceable ink cartridge so as to maintain the ink viscosity within desired limits. This solvent may also be used for flushing components of the print head, such as the nozzle and the gutter, in a cleaning cycle. It will be appreciated that circulation of the solvent requires further fluid conduits and therefore that the ink supply system as a whole includes a significant number of conduits connected between different components of the ink supply system. The many connections between the components and the conduits all represent a potential source of leakage and loss of pressure. Given that continuous ink jet printers are typically used on production lines for long uninterrupted periods reliability is an important issue. Moreover, the presence of multiple conduits in the interior of the ink supply section of the cabinet makes access to certain components difficult in the event of servicing or repair.

BRIEF SUMMARY OF THE INVENTION

A feature of the present disclosure, amongst others, to provide for an improved or an alternative ink jet printer and/or an alternative or improved ink supply system for an ink jet printer.

In one aspect, a core module for an ink jet printer includes a housing and a connection manifold disposed on the housing and including a plurality of ports providing fluid communication into and out of the core module. A plurality of components is disposed within the housing, including a filter module, an ink reservoir, and an ink circuit. The filter module includes a fluid filter disposed in a filter housing. The filter housing has an inlet and an outlet. The ink circuit is in fluid communication with the components and the ports, and includes fluid paths for conveying ink between the components. The filter module is connected to the manifold such that the filter housing inlet and outlet are each in fluid communication with one of the plurality of ports on the connection manifold.

In another aspect, a method of connecting a core module to an ink jet printer includes providing an ink jet printer with a printer connector for supplying ink to the ink jet printer. A core module is provided. The core module includes a housing. A connection manifold is disposed on the housing and includes a plurality of ports providing fluid communication into and out of the core module. A filter module is disposed within the housing. The filter module includes a fluid filter disposed in a filter housing, an ink reservoir, and an ink circuit in fluid communication with the manifold, the filter module and the ports. The printer connector is connected to the connection manifold to provide fluid communication of ink between the core module and the ink jet printer.

DETAILED DESCRIPTION

Figure 1:
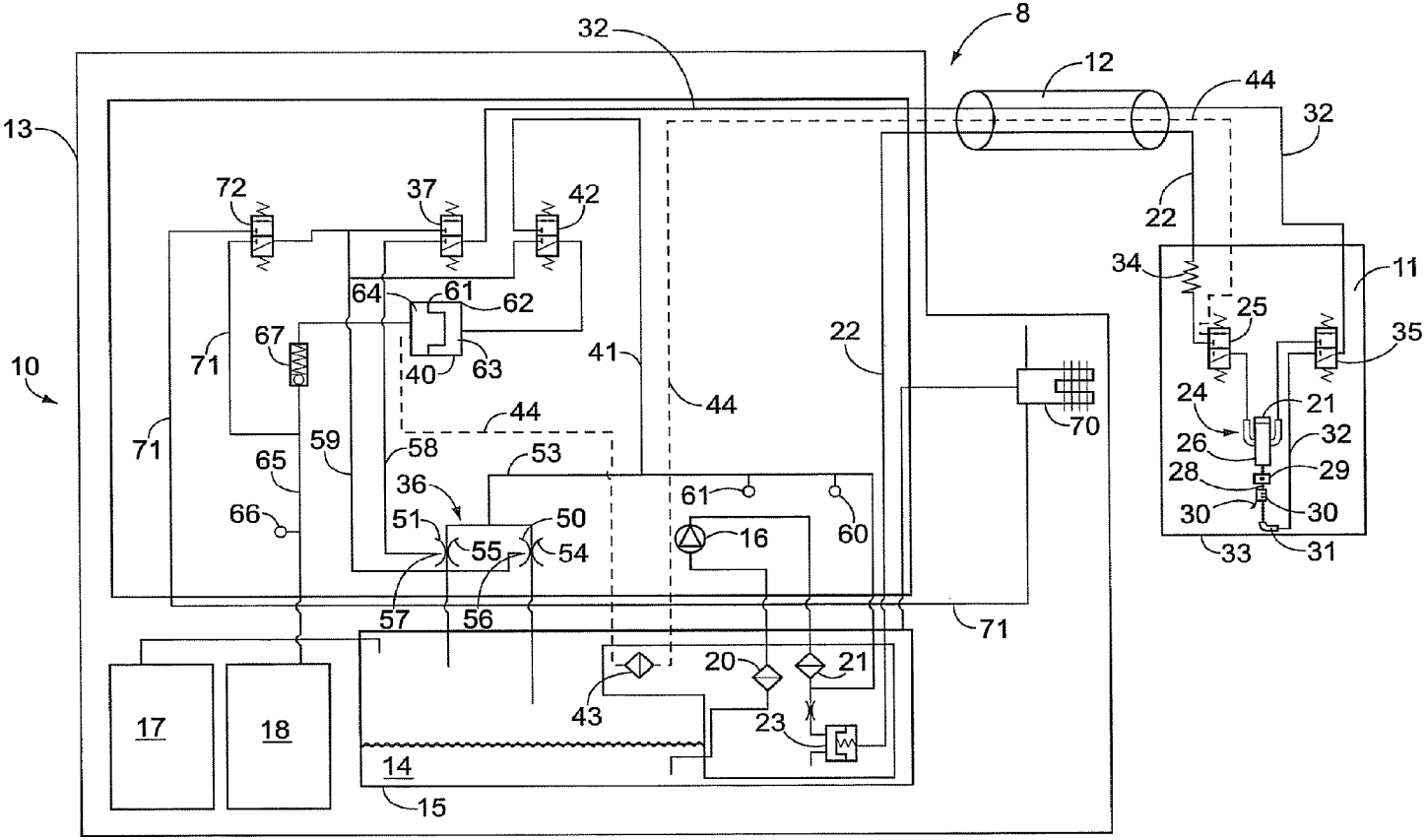
FIG. 1 is a schematic representation of an embodiment of a continuous ink jet printer of the present invention.

Referring now to FIG. 1 of the drawings, ink is delivered under pressure from an ink supply system 10 to a print head 11 and back via flexible tubes which are bundled together with other fluid tubes and electrical wires (not shown) into what is referred to in the art as an "umbilical" conduit 12. The ink supply system 10 is located in a cabinet 13 which is typically table mounted and the print head 11 is disposed outside of the cabinet. In operation, ink is drawn from a reservoir of ink 14 in a mixer tank 15 by a system pump 16, the tank 15 being topped up as necessary with ink and make-up solvent from replaceable ink and solvent cartridges 17, 18. Ink is transferred under pressure from the ink cartridge 17 to the mixer tank 15 as required and solvent is drawn from the solvent cartridge 18 by suction pressure as will be described.

It will be understood from the description that follows that the ink supply system 10 and the print head 11 include a number of flow control valves which are of the same general type: a dual coil solenoid-operated two-way, two port flow control valve. The operation of each of the valves is governed by a control system (not shown in the figures) that also controls operation of the pumps.

Ink drawn from the tank 15 is filtered first by a coarse filter 20 upstream of the system pump 16 and then by a relatively fine main ink filter 21 downstream of the pump 16 before it is delivered to an ink feed line 22 to the print head 11. A fluid damper 23 of conventional configuration and disposed upstream of the main filter 21 removes pressure pulsations caused by the operation of the system pump 16.

At the print head the ink from the feed line 22 is supplied to a drop generator 24 via a first flow control valve 25. The drop generator 24 includes a nozzle 26 from which the pressurised ink is discharged and a piezoelectric oscillator 27 which creates pressure perturbations in the ink flow at a predetermined frequency and amplitude so as break up the ink stream into drops 28 of a regular size and spacing. The break up point is downstream of the nozzle 26 and coincides with a charge electrode 29 where a predetermined charge is applied to each drop 28. This charge determines the degree of deflection of the drop 28 as it passes a pair of deflection plates 30 between which a substantially constant electric field is maintained. Uncharged drops pass substantially undeflected to a gutter 31 from where they are recycled to the ink supply system 10 via return line 32. Charged drops are projected towards a substrate 33 that moves past the print head 11. The position at which each drop 28 impinges on the substrate 33 is determined by the amount of deflection of the drop and the speed of movement of the substrate. For example, if the substrate moves in a horizontal direction, the deflection of the drop determines its vertical position in the stroke of the character matrix.

In order to ensure effective operation of the drop generator 24 the temperature of the ink entering the print head 11 is maintained at a desired level by a heater 34 before it passes to the first control valve 25. In instances where the printer is started up from rest it is desirable to allow ink to bleed through the nozzle 26 without being projected toward the gutter 31 or substrate 33. The passage of the ink into the return line 32, whether it is the bleed flow or recycled unused ink captured by the gutter 31, is controlled by a second flow control valve 35. The returning ink is drawn back to the mixer tank 15 by a jet pump arrangement 36 and a third flow control valve 37 in the ink supply system 10.

As ink flows through the system and comes into contact with air in the tank 15 and at the print head 11, a portion of its solvent content tends to evaporate. The ink supply system 10 is therefore also designed to supply make-up solvent as required so as to maintain the viscosity of the ink within a predefined range suitable for use. Such solvent, provided from the cartridge 18, is also used to flush the print head 11 at appropriate times in order to keep it clear of blockages. The flush solvent is drawn through the system 10 by a flush pump valve 40 that is driven by a flow of ink in a branch conduit 41 under the control of a fourth flow control valve 42 as will be described below. The flush solvent is pumped out via a filter 43 through a flush line 44 (represented in dotted line in FIG. 1) that extends from the supply system 10 through the umbilical conduit 12 to the first flow control valve 25 in the print head 11. After passing through the nozzle 26 and into the gutter 31 the solvent is drawn into the return line 32 via the second control valve 35 and to the third control valve 37. The returning solvent flows under suction pressure from the jet pump arrangement 36.

The jet pump arrangement 36 includes a pair of parallel venturi pumps 50, 51 that are supplied by pressurised ink from a branch line 53 from the outlet of the main filter 21. The pumps are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurised ink flows through a pair of conduits 54, 55 and back to the mixer tank 15, each conduit 54, 55 having a side port 56, 57 at the venturi restriction. The increase in flow velocity of the ink creates a suction pressure at the side port 56, 57 and this serves to draw returning ink and/or solvent through lines 58, 59 when the third flow control valve 37 is open. The flow control valve 37 is operated such that the flow of returning ink/solvent to each venturi pump 50, 51 can be separately controlled. More specifically, the control system determines whether to allow flow through one or both venturi pumps 50, 51 depending on the temperature of the ink determined by a temperature sensor 60 in the branch line 53. If the ink has a relatively low temperature it will have a relatively high viscosity and therefore greater pumping power is required to draw ink back from the gutter 31 in which case both pumps 50, 51 should be operated. In the event that the ink has a relatively high temperature it will have a relatively low viscosity in which case the only one pump 50 is required to generate sufficient suction. Indeed operation of both the pumps should be avoided in the latter circumstance, as there would be a risk of air getting into the supply system, which serves to cause excess evaporation of the solvent, and therefore increased consumption of make-up solvent.

The branch line 53 is connected to line 41 that conveys ink to the flush pump valve 40 via the fourth flow control valve 42. When the control valve 42 is appropriately operated by the control system in order to effect flushing of the print head 11 it allows the flush pump valve 40 to be pressurised by the ink from line 41. The valve 40 is a rolling diaphragm type in which a resilient "top-hat" diaphragm 61 divides a valve housing 62 into first and second variable volume chambers 63, 64. Ink is supplied under pressure to the first chamber 63 and make up solvent is delivered from the cartridge 18 through a solvent supply line 65 to the second chamber 64 via a pressure transducer 66 and a non-return valve 67. The higher pressure of the ink entering the first chamber 63 relative to the solvent serves to deflect the diaphragm 61 from its normal position as shown in FIG. 1, to a position where the volume of the first chamber 63 has increased at the expense of the volume of the second chamber 64 and solvent is forced out of the second chamber 64 and towards the print head 11 via the flush line 44. It is to be appreciated that other flush pump designs may be used to achieve the same operation.

In use, the atmosphere above the mixer tank 15 soon becomes saturated with solvent and this is drawn into a condenser unit 70 where it is condensed and allowed to drain back into a solvent return line 71 via a fifth control valve 72 of the ink supply system.

The ink supply system 10, represented in circuit form in FIG. 1, is physically embodied as a modular unit or core module 200 that is illustrated in FIGS. 2A to 2C and 11. The mixer tank 15 includes a reservoir with a base wall 75, upstanding sidewalls 76 and an open top that defines a mouth 77. The side walls 76 terminate at their upper edge in a peripheral flange 78 around the mouth 77 and provide support for a manifold block 79, which provides fluid flow conduits between components of the ink supply system, many of which are conveniently supported on the block 79.

The manifold block 79 includes two vertically stacked, interconnected parts: a tank-side feed plate 80 that supports a number of components over the ink in the tank 15 and an upper manifold plate 81 on which further components are supported. The plates 80, 81, which are shown in detail in FIGS. 3A to 3C and 4A to 4C, are generally square in outline, with the tank-side feed plate 80 being slightly smaller such that it fits inside the mouth 77 when the peripheral edge 82 of the manifold plate 81 rests on the flange 78 around the tank mouth 77. A seal 83 is provided between the flange 78 and the edge 82 of the manifold plate 81. Each of the plates 80, 81 has an upper and a lower surface 80*a*, 80*b* and 81*a*, 81*b*, and the stacked arrangement is such that the lower surface 81*b* of the manifold plate overlies, and is in interfacing abutment with the upper surface 80*a* of the feed plate 80.

Figure 3A:
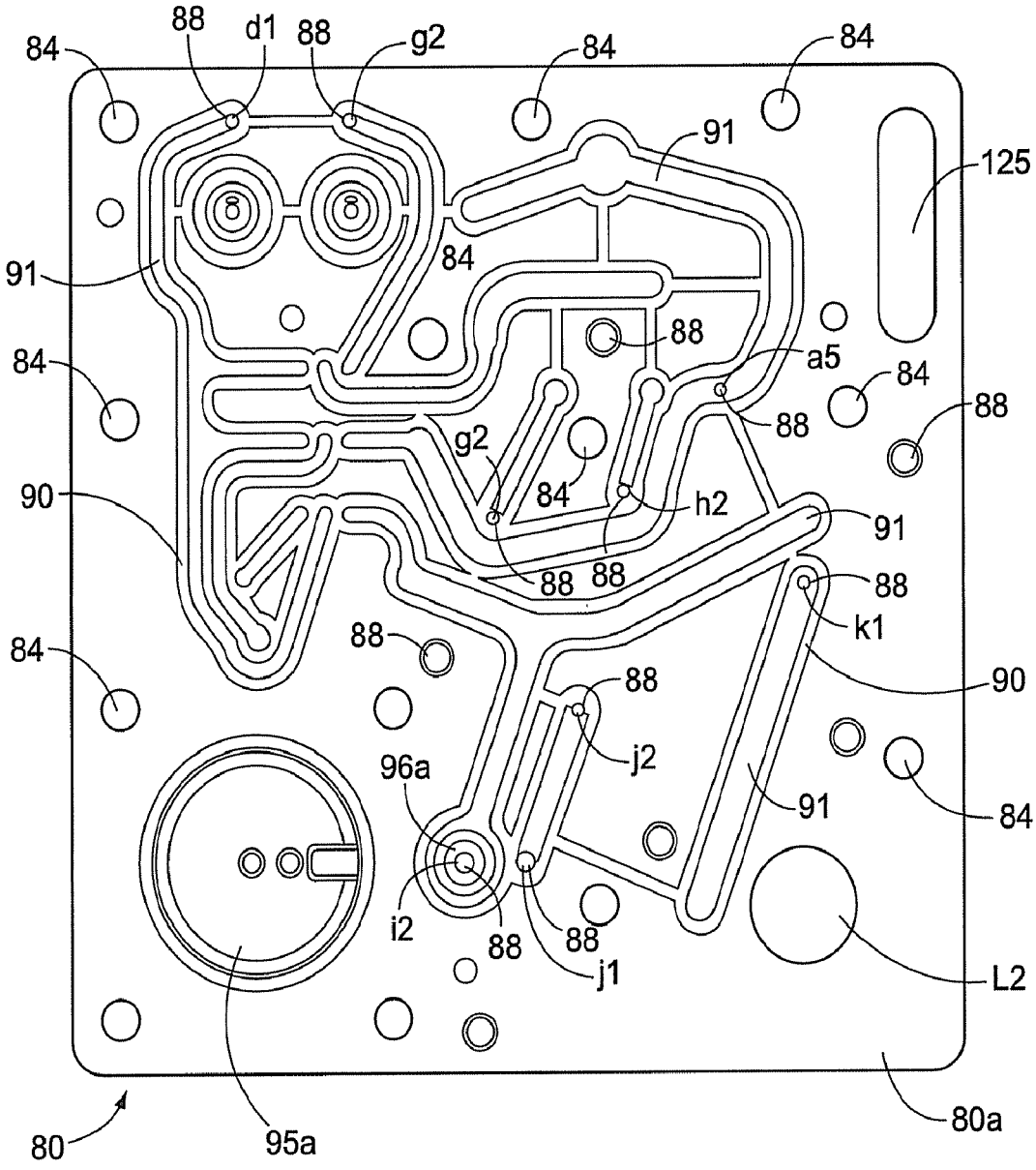
FIG. 3A is a plan view of an upper surface of a feed plate of the ink supply system of FIGS. 2A and 2B.
Figure 3C:
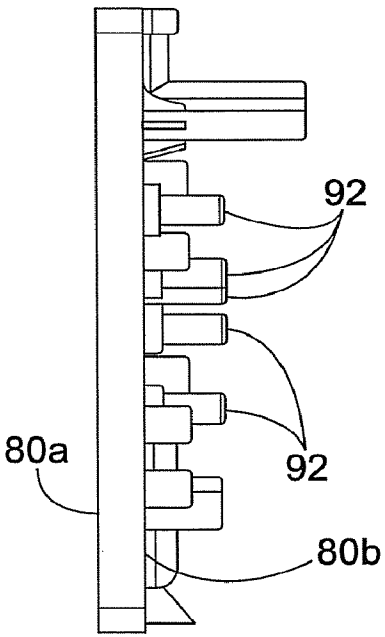
FIG. 3C is a side view of the feed plate in the direction of arrow A of FIG. 3B.
Figure 3B:
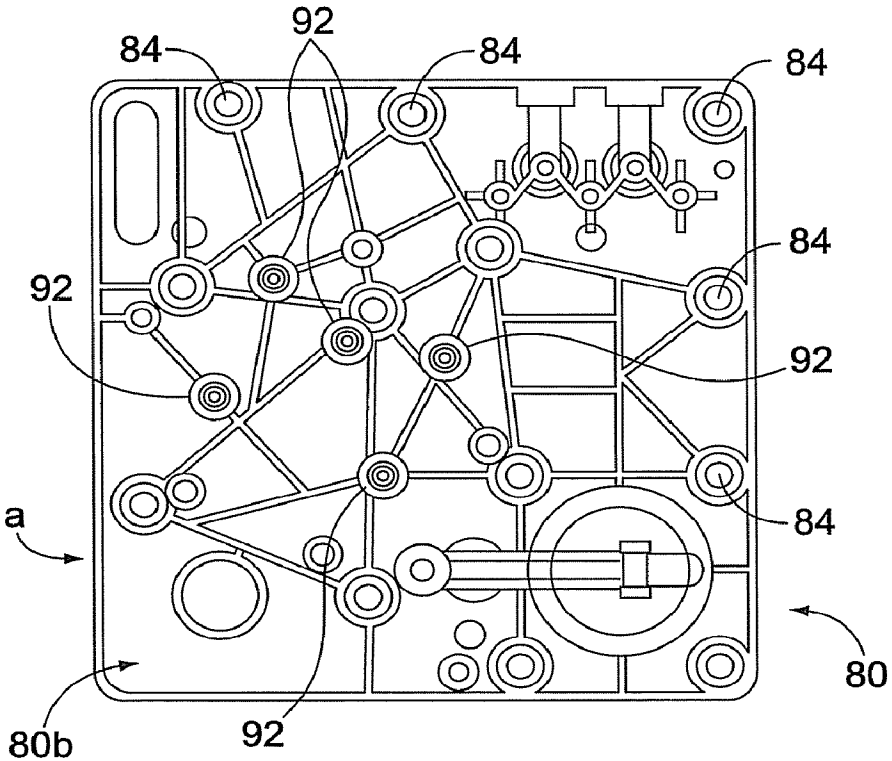
FIG. 3B is a plan view of a lower surface of the feed plate of FIG. 3A, with components removed for clarity.
Figure 4A:
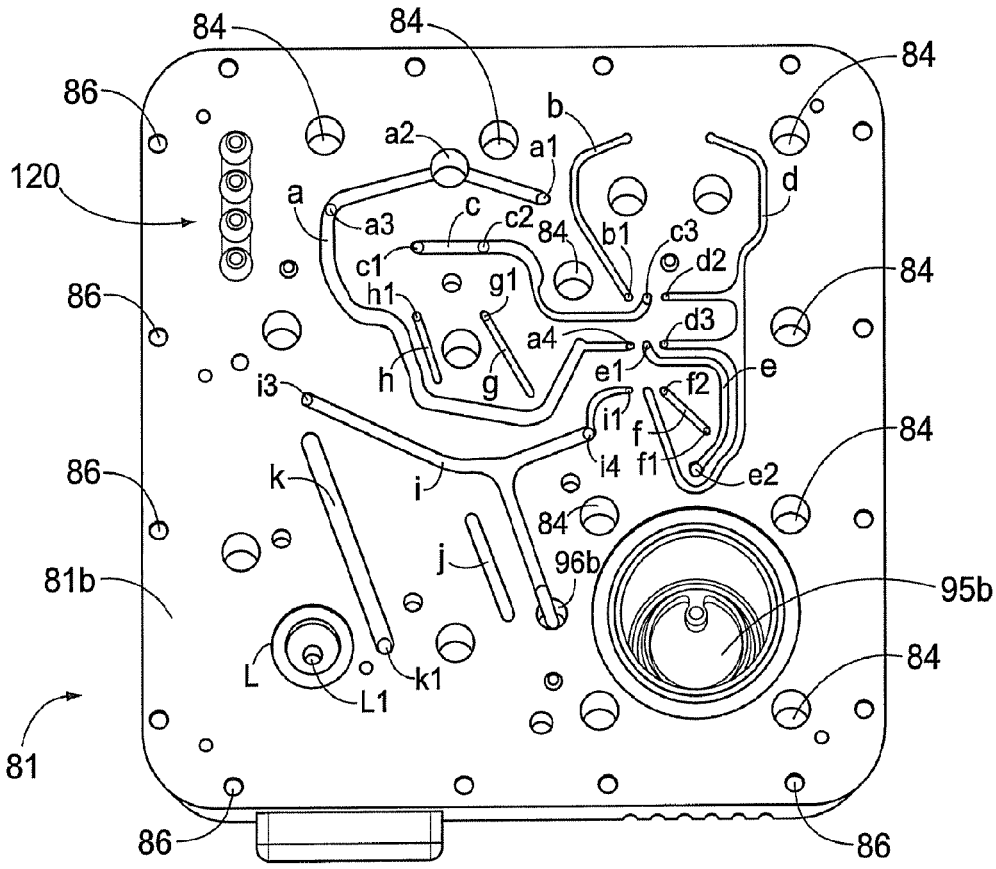
FIG. 4A is a plan view of a lower surface of a manifold plate of the ink supply system of FIGS. 2A and 2B.

The plates 80, 81 are penetrated in a direction substantially perpendicular to the plane of the interfacing surfaces 80*a*, 81*b* by a number of aligned fixing apertures 84 (FIG. 3A) for fixing screws (not shown) that are used to connect the plates together. The manifold plate 81 additionally has a plurality of apertures 86 spaced about its periphery for location over upstanding pegs 87 on the flange 78 of the tank 15, and a plurality of ports 88 (see FIG. 3A) for connection to components of the ink supply system 10. The flow of ink between the ports 88, and therefore the components of the ink supply system, is provided by a plurality of discrete channels A to K defined in the lower surface 81*b* of the manifold plate 81. The channels A-K interconnect the ports 88 in a predetermined relationship as can be seen in FIGS. 3A and 4A. When the interfacing surfaces 80*a*, 81*b* of the plates 80, 81 are brought together the channels A-K are covered by the upper surface 80*a* of the feed plate 80 and sealed by a sealing member 89 that is received in a pattern of recesses 90 defined in that surface 80*a*. The sealing member 89 is made from a moulded elastomeric material such as synthetic rubber of the kind used in O-ring seals and is compressed in the recesses when the plates 80, 81 are fastened together. It is configured such that it includes a plurality of ring seals, each designed to seal around a particular channel when the plates 80, 81 are brought together, the seals being interconnected to form one member for convenience. The sealing member 89 demarcates selected areas 91 of the upper surface 80*a* that generally correspond to the pattern of channels A-K defined on the manifold plate 81, these areas 91 serving to close the channels A-K whilst the sealing member 89 seals the channels A-K against leakage. Some of the areas 91 bounded by the sealing member 89 contain the ports 88 that allow fluid communication between the channels A-K and the components mounted on the feed plate 80. A plurality of spigots 92 extend substantially perpendicularly from the ports 88 on the lower surface 80*b* feed plate 80 and provide for easy connection of the components to the ports 88.

The upper surface 81*a* of the manifold plate 81 has upstanding side walls 93 spaced inwardly of the peripheral apertures 86, the area inside the walls 93 being configured to support components of the ink supply system 10.

The arrangement of the channels A-K in the manifold plate 81 is shown clearly in FIG. 4A, with the sealing recesses 90 and channel closure areas 91 being shown on the feed plate 80 in FIG. 3A. The relationship of the channels A-K to the flow lines and conduits of the ink system 10 of FIG. 1 is summarised below.

Channel A defines the branch line 53 and connected line 41 for pressurised ink that extend from the outlet of the main filter 21, which is connected to port A5 on the feed plate 80, to the jet pump 36 inlet that is connected to port A1. Line 41 is connected to the fourth control valve 42 (which controls activation of the flush pump) via port A4. The pressure transducer 61 is in fluid communication with the conduit via port A3 and a temperature sensor 60 via port A2.

Channel B interconnects the second venturi jet pump 51 and the third control valve 37 which allows the flow to pump 51 to be switched on and off. Port B1 in the manifold plate 81 is connected to the valve 37 and port B2 (FIG. 3A) in the feed plate 80 connects to the venturi pump 51.

Channel C defines part of the ink return line 32 from the print head 11 and interconnects the return line (port C2) in the umbilical conduit 12 from the print head 11 to the third control valve 37 (port C3). Port C1 is not used.

Channel D defines the conduit that carries the flow of ink returning from the first chamber 63 of the flush pump 40 (via the fourth control valve 42) to the first venturi pump 50 of the jet pump arrangement 36 and/or the recovered solvent from the condenser unit 70. Port D1 on the feed plate 80 connects to the first venturi pump 50, port D2 on the manifold plate 81 to an outlet of the third control valve 37, port D3 to the fourth control valve 42 and port D4 to the fifth control valve 72 (controlling the flow of recovered solvent from the condenser unit 70).

Channel E defines the conduit 41 that delivers pressurised ink to the flush pump valve 40 and interconnects an outlet of the fourth control valve 42 (port E1 in the manifold plate 81) to the inlet (port E2 in the manifold plate 81) of the first chamber 63 of the flush pump valve 40.

Channel F defines part of the solvent return line 71 from the condenser unit 70 and interconnects the condenser drain (port F1 in the manifold plate 81) to the fifth control valve 72 (at port F2 in the manifold plate 81).

Channel G defines part of the solvent flush line 44 and interconnects that to the flush line tube in the umbilical conduit 12 to the print head 11 (port G1 on the manifold plate 81) and an outlet of the solvent flush filter 43 (port G2 on the feed plate 80).

Channel H defines part of the ink feed line 22 and interconnects the outlet of the damper 23 (port H2 in the feed plate 80) and ink feed line tube in the umbilical conduit 12.

Channel I defines the solvent supply line 65 from the solvent cartridge 18 and interconnects the end of a conduit from the cartridge 18 (that end being connected to port 14 in the manifold plate 81) to the fifth control valve 72 (port I1 in the manifold plate 81). It also provides fluid communication with the non-return valve 67 (port 12 in the feed plate 81) and the pressure transducer 66 (port 13).

Channel J defines the solvent flow conduit between the non-return valve 67 and the flush pump 40. Port J1 in the feed plate 80 provides fluid communication between the inlet to the second chamber 64 of the flush pump 40 and port J2, also in the feed plate 80, with an outlet of the non-return valve 67.

Channel K defines part of the main ink feed line 22 and extends between the outlet of the system pump 16 (port K2 on the manifold plate 81) and the inlet of the main filter 21 (port K1 on the feed plate 80).

Ports L1 on the manifold plate 81 and L2 on the feed plate 80 simply allow a direct connection between the outlet of the coarse filter 20 and the inlet of the system pump 16 without any intermediate flow channel.

Figure 5A:
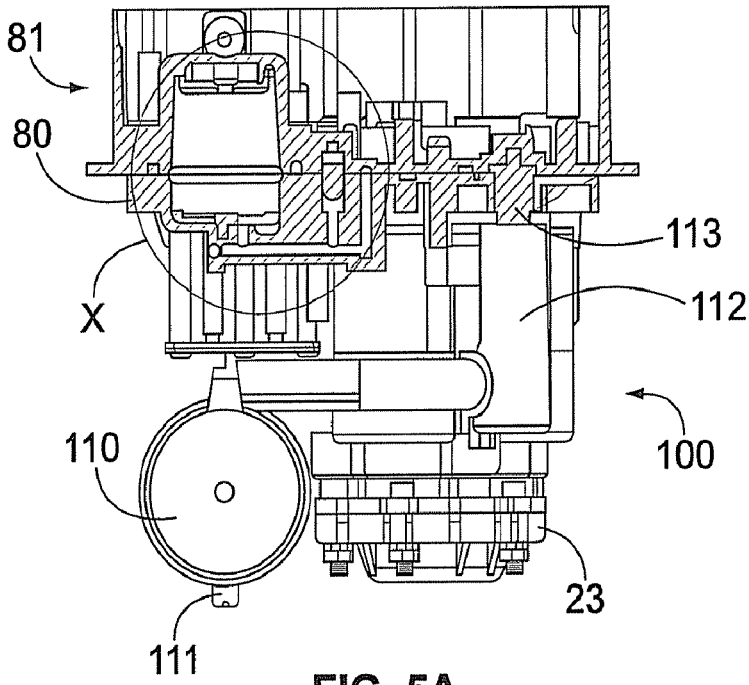
FIG. 5A is a partially sectioned side view of part of the ink supply system of FIGS. 1, 2A and 2B.
Figure 5B:
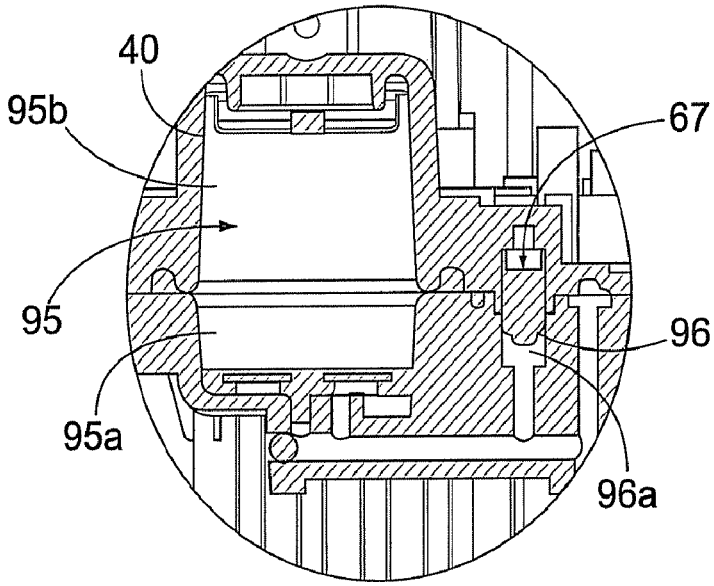
FIG. 5B is an enlarged view of the encircled part labelled X in FIG. 5A.
Figure 6A:
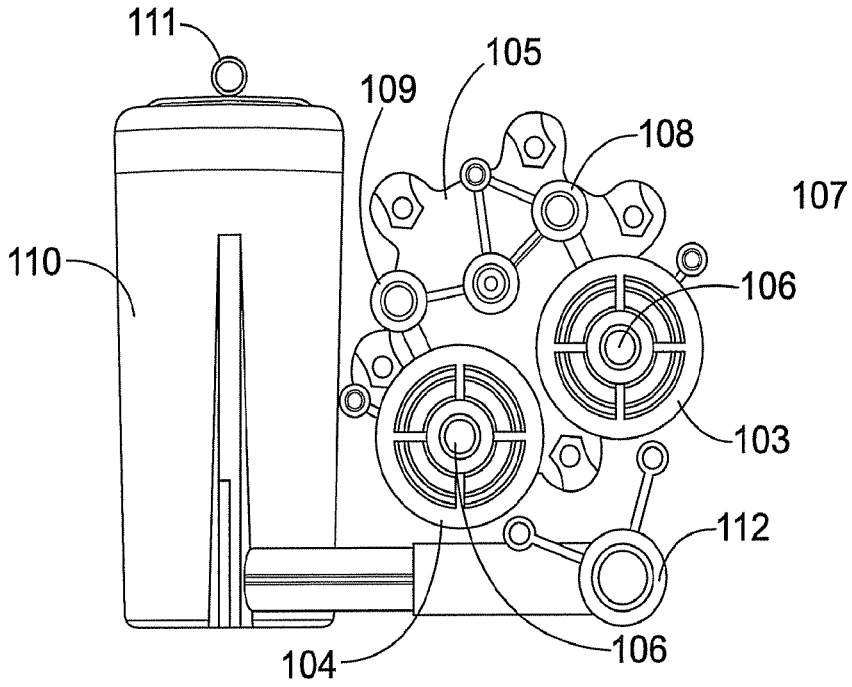
FIGS. 6A and 6B are end views of part of a filter module of the ink supply system.
Figure 6B:
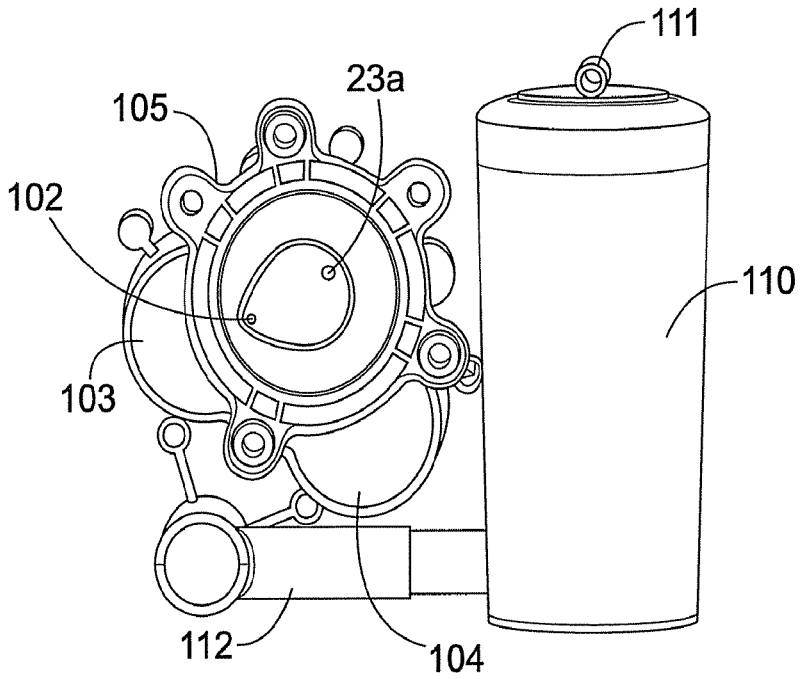
Figure 7A:
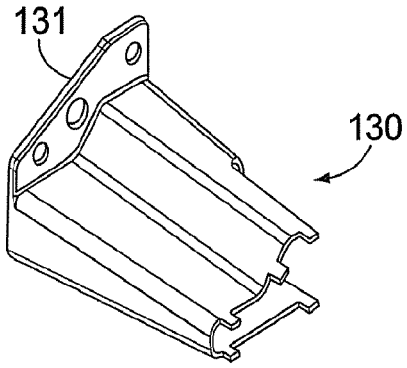
FIGS. 7A to 7D are respective perspective, side, side sectioned (along line B-B of FIG. 7D) and underneath plan views of the guard of FIG. 4C.
Figure 7B:
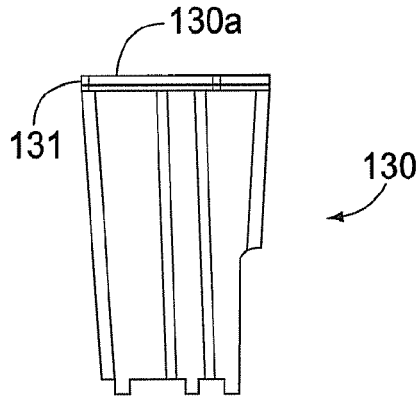
Figure 7C:
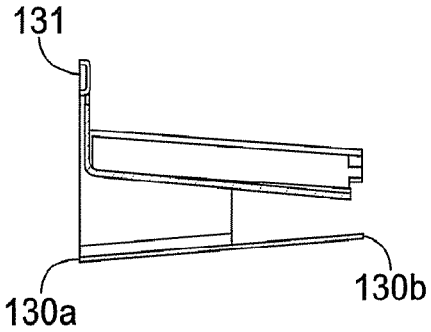
Figure 7D:
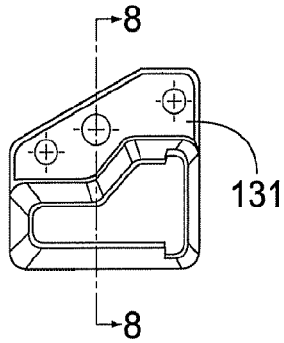

Each of the interfacing surfaces 80*a*, 81*b* of the plates 80, 81 has a large cylindrical recess 95*a*, 95*b* which combine when the plates are brought together, so as to form a chamber 95 for housing the flush pump 40, as best seen in FIGS. 5A and 5B. Similarly, the non-return valve 67 sits in a small chamber 96 defined between recesses 96*a*, 96*b*.

Referring back to FIGS. 2A and 2B, the modular nature of the ink supply system 10 will now be more clearly appreciated. The manifold block 79 configuration allows the various ink supply system components to be plugged simply into fluid communication with the ports 88 (or the spigots extending from the ports) and therefore the fluid flow channels in a modular fashion.

Figure 2A:
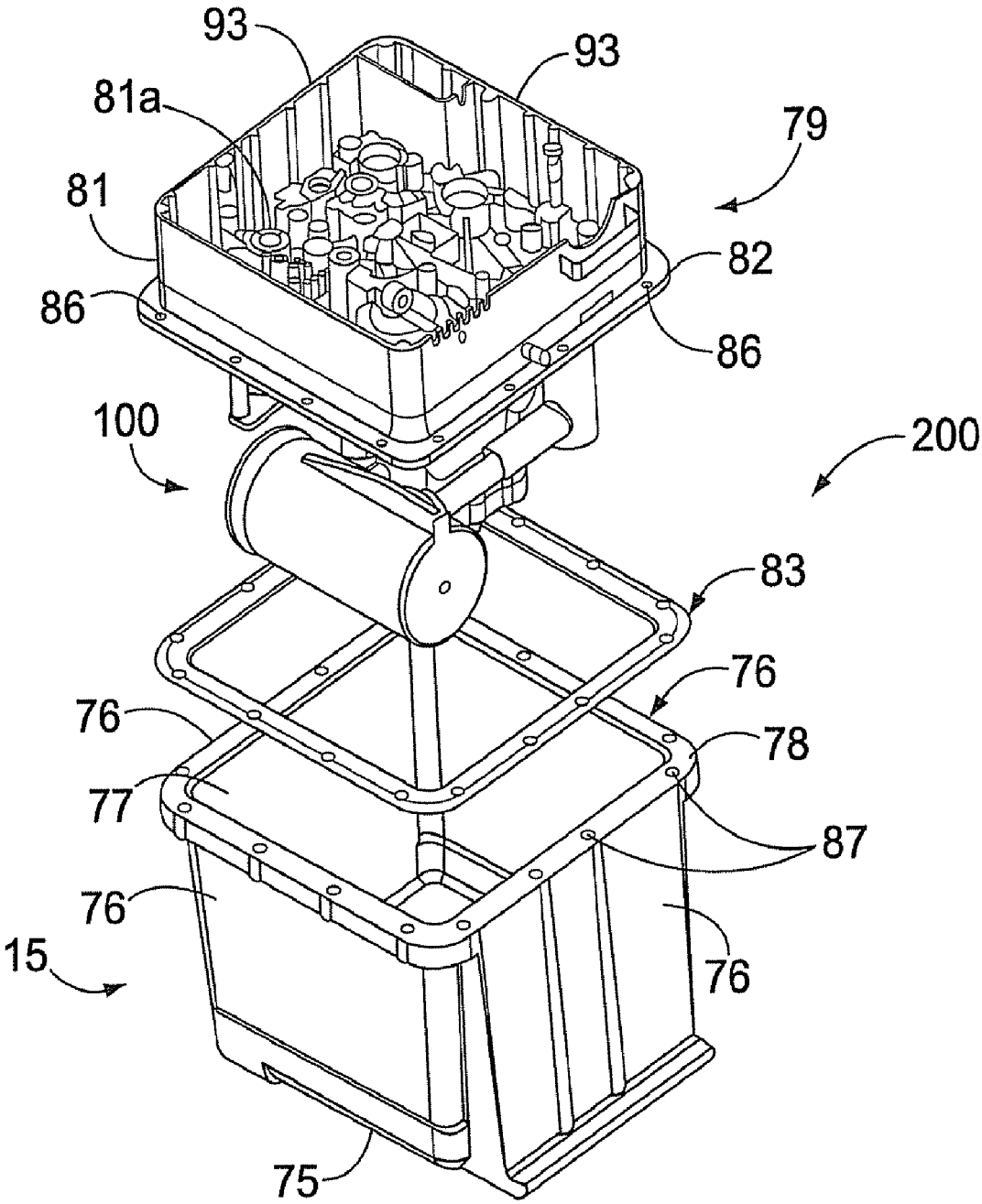
FIG. 2A is an exploded perspective view from above of part of the ink supply system of FIG. 1.
Figure 2C:
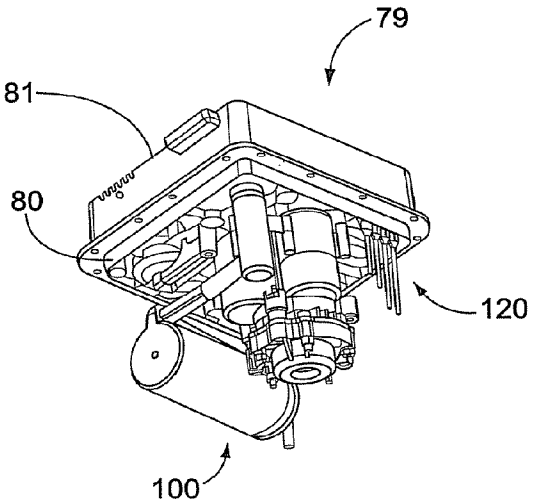
FIG. 2C is a perspective view from below of the ink supply system of FIGS. 1, 2A and 2B in a partially assembled condition.
Figure 2B:
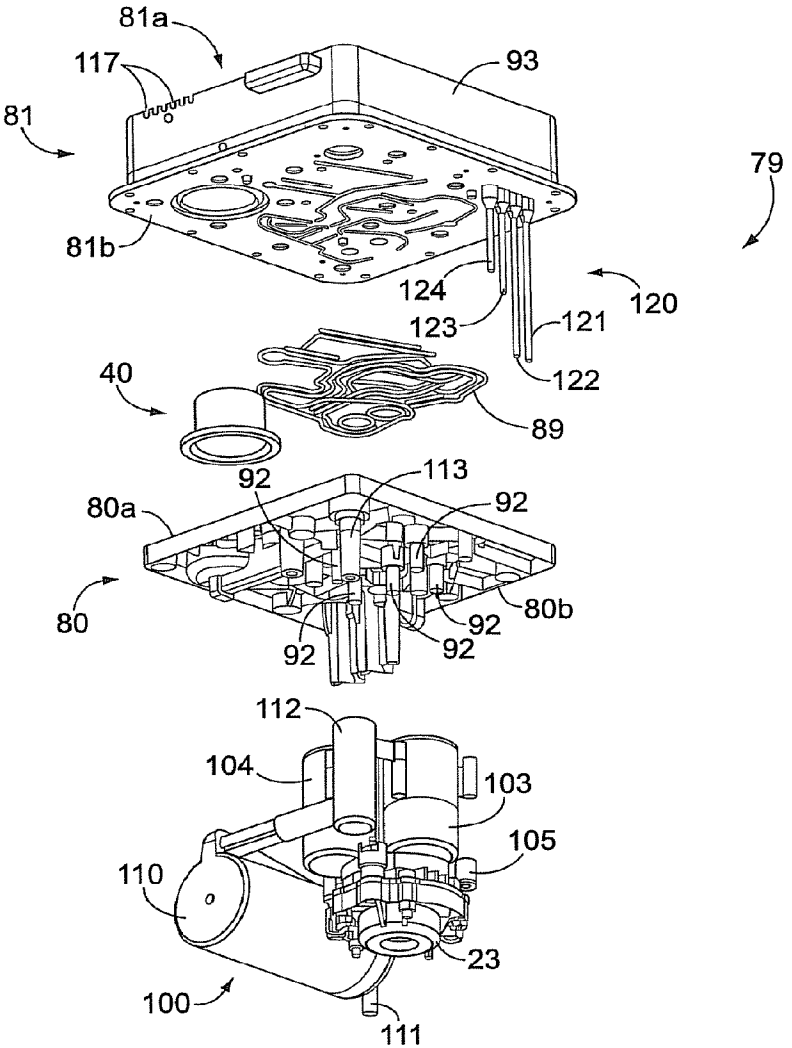
FIG. 2B is a further exploded perspective view of part of the ink supply system of the printer of FIG. 1.

Some of the ink supply system components supported on the manifold block 79 will now be described with reference to FIGS. 2 to 7. An integrated filter and damper module 100 is connected to the lower surface 80*b* of the feed plate 80 by five spigots 92 as shown in FIGS. 2B and 2C. Two of the spigots are for mounting purposes only whereas the other spigots 92 extend rearwardly from ports K1, G2 and H2 in the plate. The module 100, shown separately in FIGS. 6A and 6B includes a pair of cylindrical housings 103, 104 that are integrally formed with a mounting support 105 for the damper 23 (not shown in FIGS. 6A and 6B but shown in FIGS. 2B, 2C and 5A). A first housing 103 contains the main ink filter 21 and the second housing 104 houses the solvent filter 43. Each of the cylindrical housings 103, 104 has a central inlet opening 106 that fits over a respective spigot 92 in a friction fit, the opening for the main ink filter 21 connecting to the spigot at port K1 and the opening for the solvent filter 43 connecting to the spigot at port J2. A suitable sealing ring may be provided between each spigot 92 and inlet opening 106. The filtered ink egresses from the housing 103 at aperture 102, passes through the mounting support 105 to an inlet of the damper 23 and exits the damper and support 105 at aperture 23*a* to an integrally formed outlet conduit 107 that extends substantially parallel to the axis of the cylindrical housing 103, 104 and connects to the spigot 92 at port H2. A further conduit 108 extends from a side opening in the ink filter housing 103 and connects to the spigot 92 at port A5 from where the ink flows into the branch line 53 defined by channel A. The filtered solvent passes through a side aperture in the housing into a conduit 109 that connects to the spigot 92 at port G2 from where it flows into the flush line 44 defined by channel G.

It will be seen that the inlets 106 and the outlet conduits 107, 108, 109 are disposed substantially in parallel so that the module 100 can be plugged into the manifold block 79 with relative ease, with the inlets and conduits sliding on to the respective spigots 92.

The filter and damper module 100 also includes the coarse filter 21 in a further cylindrical housing 110 whose inlet has a take up pipe 111 for connection to a tube (not shown) that extends into the ink 14 at the bottom of the mixer tank 15. In operation, the system pump 16 (upstream of the coarse filter 21) operates to draw ink from the tank 15 through the take up pipe 111 and into the coarse filter 21. The outlet of the coarse filter 21 directs filtered ink along an integral right-angled outlet conduit 112 that connects to port L1 in the manifold plate from where ink flows to an inlet pipe 113 (FIGS. 4C and 5A) of the system pump 16, which extends through ports L2 and L1 and into the end of the filter outlet conduit 112.

Several components of the ink supply system 10 are mounted on the upper surface 81*a* of the manifold plate 81, these include in particular the jet pump assembly 36, system pump 16, the third to fifth flow control valves 37, 42, 72, temperature sensor 60, pressure transducer 61, and a circuit board 115 for terminating electrical wiring connecting the valves, pumps and transducers to the control system. Many of these components are hidden from view in FIG. 4B by the circuit board 115.

The three flow lines 22, 32, 44 are partly defined by respective tubes in the umbilical conduit 12 as described above and these connect to the respect ports H1, C2, G1 that are conveniently grouped together at a connection block 116 (FIG. 4B) defined on the upper surface 81*a* of the manifold plate 81. The tubes are supported in cut-out notches 117 (FIG. 2B) in the side wall 93.

Figure 4C:
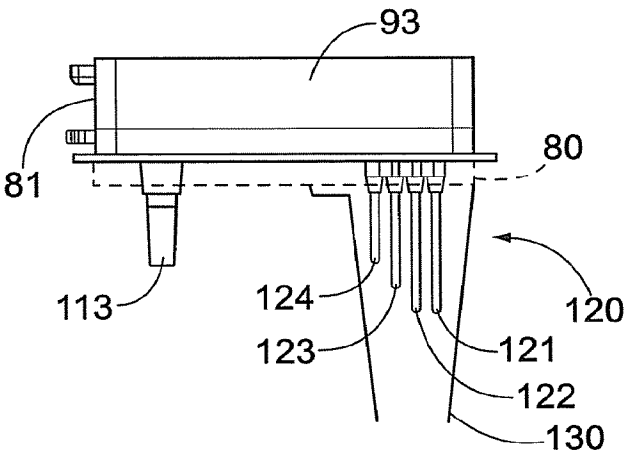
FIG. 4C is a side view of the manifold plate in the direction of arrow A of FIG. 4B, with components removed for clarity, the feed plate being shown in dotted line and an ink level sensor guard being shown in section.
Figure 4B:
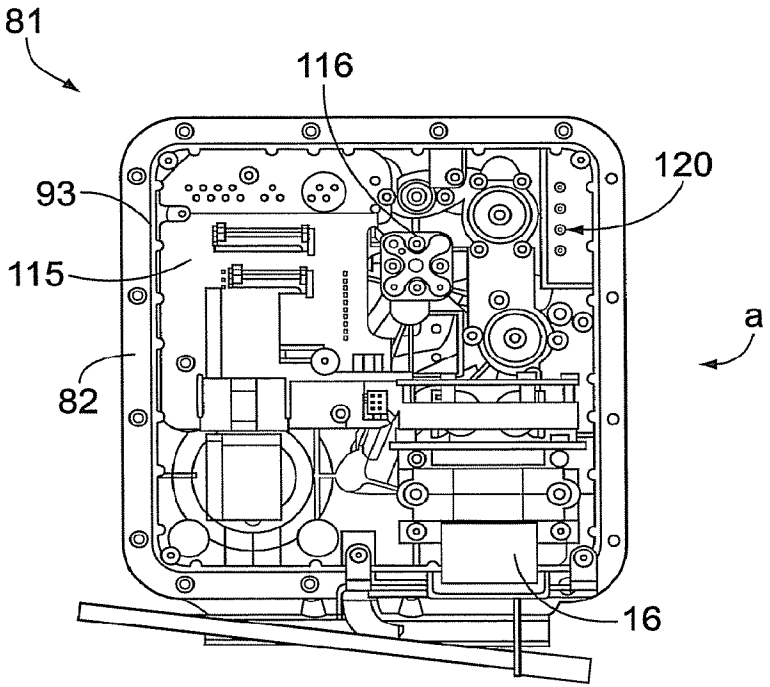
FIG. 4B is a plan view of an upper surface of the manifold plate of FIG. 4A when fitted with components.

An ink level sensor device 120 shown in FIGS. 2B, 2C, and 4C is provided on the manifold block 79 in order to detect the level of ink in the mixer tank at any given time. It includes four electrically conductive pins 121, 122, 123, 124 that depend from the lower surface 81*b* of the manifold plate 81. They extend through a slot 125 in the feed plate 80 and into the tank 15 where they are designed to dip into the ink 14. The first and second pins 121, 122 are of the same length; a third 123 of intermediate length and the fourth 124 has the shortest length. The pins are connected to one or more electrical sensors (e.g. current or a capacitance sensors) and an associated electrical circuit 115 mounted on the upper surface 81*a* of the manifold plate 81. The sensor 120 is designed to sense the presence of the electrically conductive ink when it completes an electrical circuit between the first pin 121 and one or more of the other pins 122, 123, 124. For example, when the level of ink in the tank is relatively high the ends of all of the pins 121-124 will be immersed in the ink and the sensor(s) detects that all the circuits are complete. On the other hand when the level of ink is relatively low only the longer first and second pins 121, 122 are immersed in ink and therefore a circuit is completed only between those two. A signal indicative of the measured level of ink is sent to the control system, which can then take a decision on whether more ink should be delivered into the tank 15. It is to be appreciated that other forms of ink level sensing devices may be used to the same effect.

In operation, ink and solvent returning into the tank from the return line 32 may cause turbulence, particularly at the surface of the ink 14, such that foam of bubbles is formed on the surface of the ink owing to surfactants present in the ink. It is known that a deflector plate may be used at the outlet of the return line to reduce the turbulence caused by the returning ink/solvent but this does not always eliminate foam entirely. The presence of the foam can mask the real level of ink in the tank and lead to erroneous readings by the level sensor 120. In order to counteract interference with the correct operation of the level sensor 120, a guard 130 is connected to the lower surface 80*b* of the feed plate 80 and depends downwards into the tank 15 such that it shields the pins 120-124 from any surface foam generated by incoming ink or solvent. This is illustrated in FIG. 4C. The guard 130, shown in detail in FIGS. 7A-D, includes a continuous thin wall made from, for example, a porous polypropylene material that has an upper end 130*a* with an integral laterally extending flange 131 for connecting to the feed plate 80 and a lower end 132 that, in use, is proximate to the base wall 75 of the tank 15. The wall tapers inwardly between its upper and lower end 130*a*, 130*b* and surrounds the pins 120-124 such that the ink within its confines is maintained substantially free of foam and a correct level reading can therefore be determined. It will be appreciated that the guard 130 may be used with any form of level sensor that depends upon immersion within the ink in the tank and that the wall may be manufactured from any suitable material, porous or otherwise.

Figure 9:
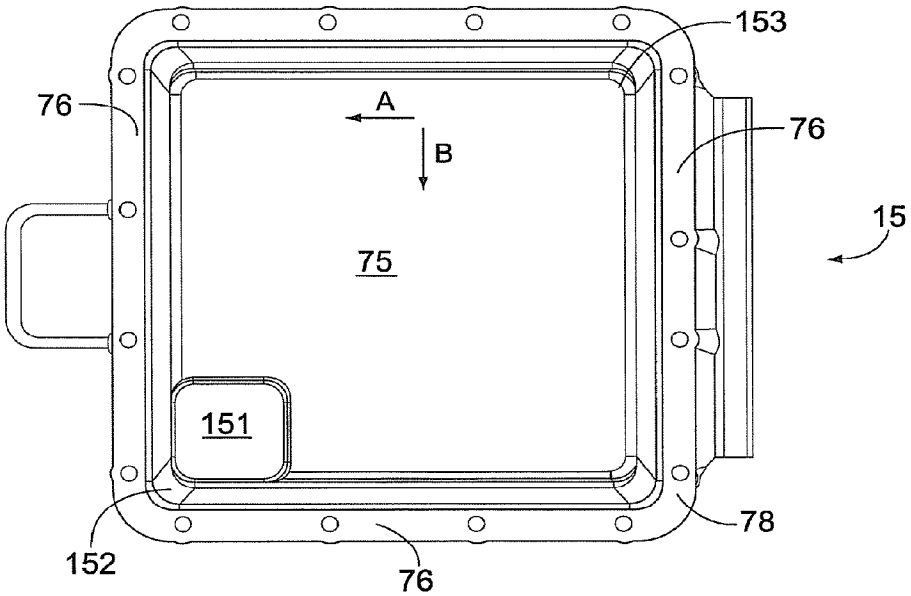
FIG. 9 is a plan view of the mixer tank of FIG. 8.
Figure 8:
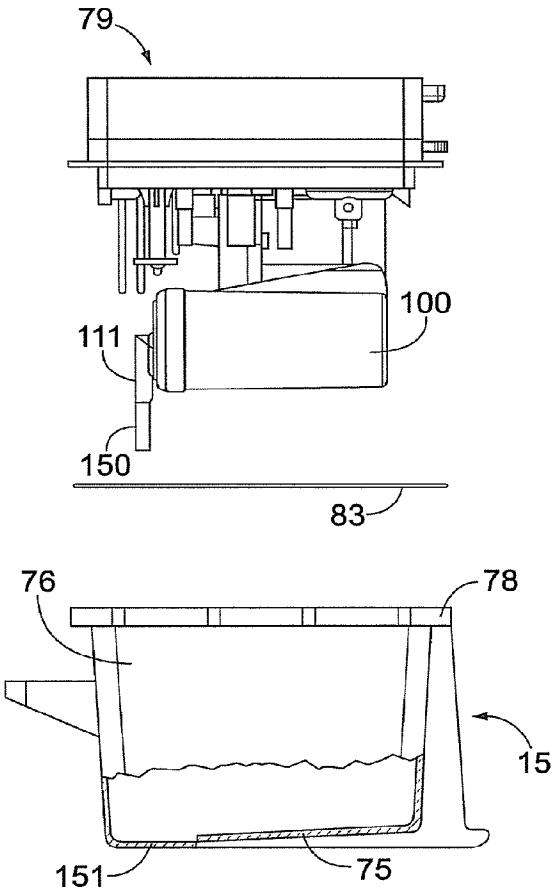
FIG. 8 is an exploded side view of the arrangement shown in FIG. 2A, a mixer tank of the supply system being shown in partial section.
Figure 10:
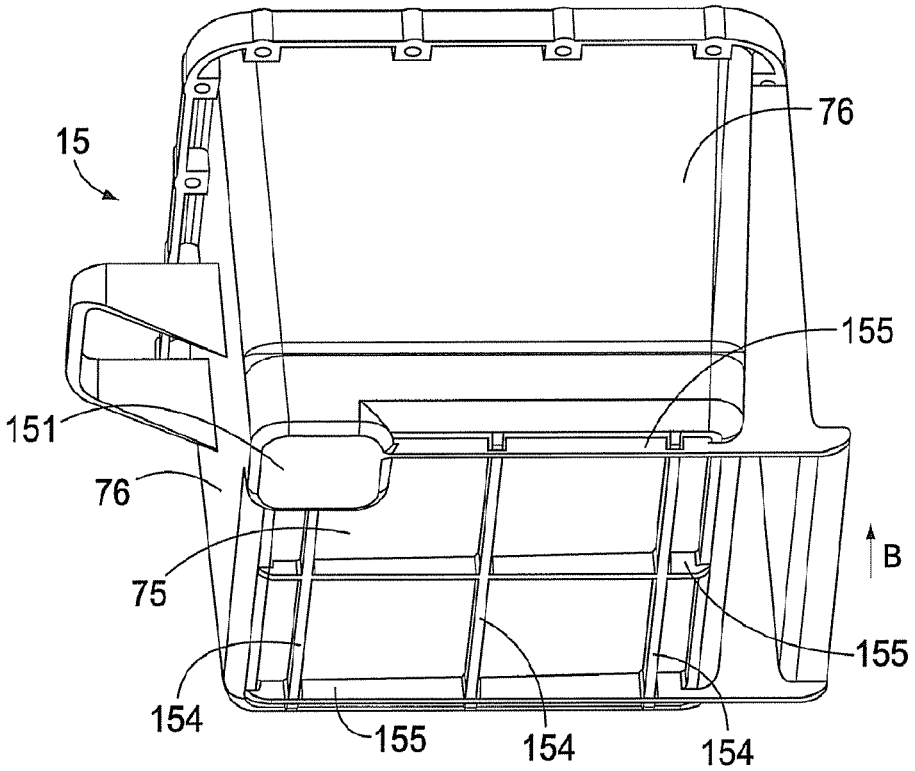
FIG. 10 is a perspective view from underneath of the mixer tank of FIG. 9.

The mixer tank 15 is shown in more detail in FIGS. 8 to 10. The base wall 75 of the tank 15 has a generally planar upper surface that is interrupted by a recess that defines a small, shallow well 151 in one corner 152. The well 151 is substantially square in the embodiment shown but it will be readily appreciated that any suitable shape may be adopted. The rest of the base wall 75 is inclined downwardly from the opposite corner 153 to the well 151 such that, in use, any residual ink remaining in the bottom of an otherwise empty tank will collect in the well 151 at the bottom of the incline. The inclination will be evident from an inspection of FIGS. 8 and 10. In the embodiment shown the base wall is inclined downwardly in two orthogonal directions as represented by arrows A and B in FIGS. 9 and 10. The base wall 75 is supported on its underside by a plurality of tapering ribs 154, 155 that provide strength and rigidity. A first set of three spaced parallel ribs 154 extend in a first direction and a second set of three spaced parallel ribs 155 extend in a second direction which is perpendicular to the first direction.

It will be appreciated that as an alternative to the base wall itself being inclined it may be sufficient for just the upper surface to be inclined relative to a lower surface of the wall.

When the manifold block 79 is mounted on the tank 15 the tube 150 that depends from the take up pipe 111 of the filter and module 100 is positioned such that its end extends into the well 151. Alternatively the take up pipe 111 may extend directly into the well 151 without the need for a separate tube 150. Thus, in circumstances when volume of ink in the tank 15 approaches empty, the system pump 16 is able to draw on the residue ink that has collected in the well 151. This ensures that very little of the available ink in the tank 15 is wasted and that the supply of ink is not interrupted until the last possible moment.

Figure 11:
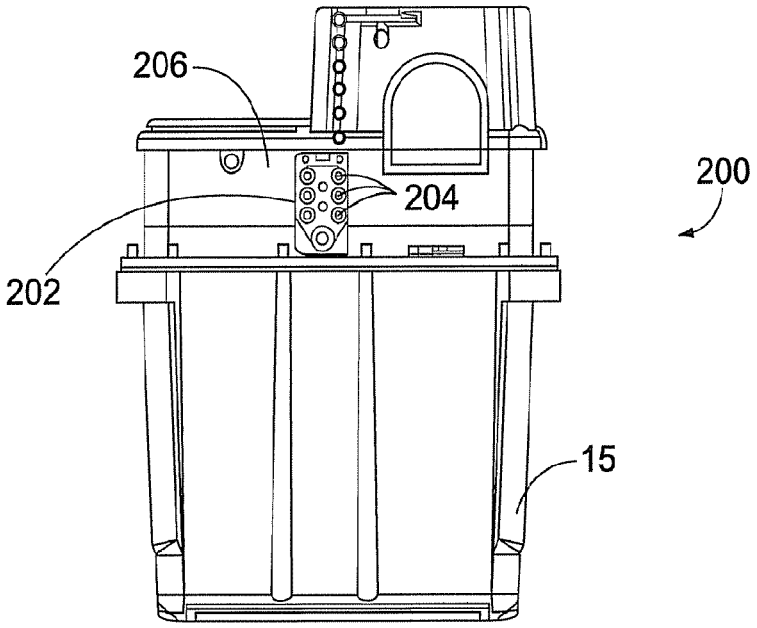
FIG. 11 is a rear view of an embodiment of a module.
Figure 12:
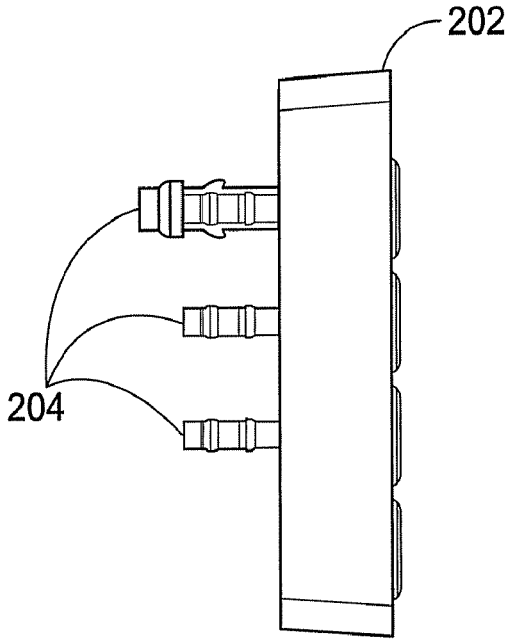
FIG. 12 is a side view of a portion of a manifold of the module of FIG. 11.

FIG. 11 shows an assembled core module 200. The module 200 is part of the ink supply system 10. As previously described, the core module 200 preferably contains such components as the filter module 100, the ink reservoir/mixer tank 15, system pump 16, solvent filter 43, and so forth. Thus, the core module 200 may perform multiple functions, including cleaning the ink, mixing the ink and the makeup solvent, supplying ink to the print head, and receiving ink and solvent. Disposed on the surface of the module 200 is a connection manifold 202. As also shown in FIG. 12, connection manifold 202 includes a plurality of connection ports 204, which are in fluid communication with manifold block 79 (as shown in FIG. 2A). Connection manifold 202 is adapted to be connected with the ink jet printer 8 to provide ink, solvent, and so forth to the printer 8. Ports 204 may be located on a single surface 206 of the module 200.

Figure 13:
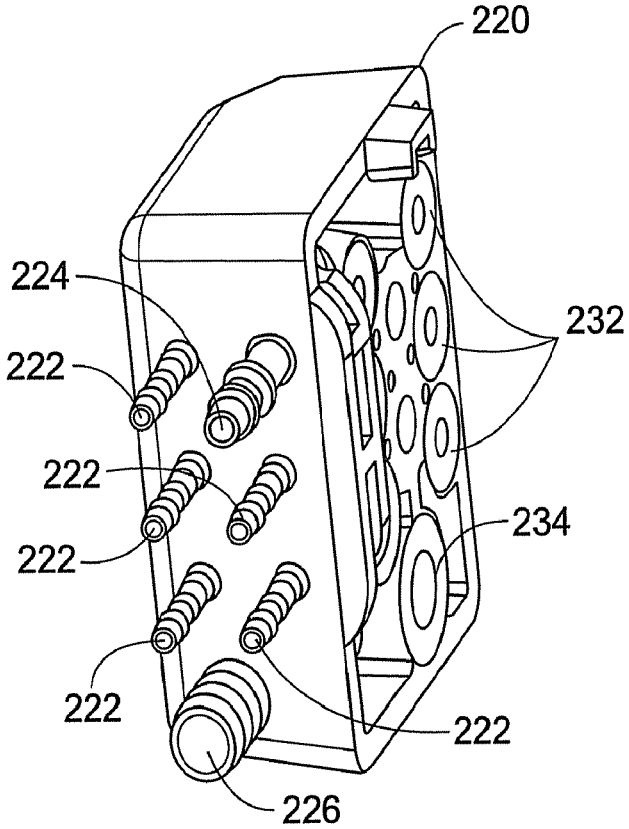
FIG. 13 is a perspective view of an embodiment of a connector for an ink jet printer.

FIG. 13 shows a connector 220 of printer 8 that is configured for connection to manifold 200 to provide fluid communication between the module 200 and the printer 8. Connector 220 includes barbs 222, 224, 226 configured for connection to feed and return lines (not shown) of the ink jet printer 8. Additionally, openings 232, 234 of connector 220 are configured for connection to connection ports 204 of manifold 202. Although a particular configuration of ports, barbs, and openings is shown in the figures, other suitable configurations are possible. The configuration of connection ports 204 and connector 220 is preferably such that connector 220 is easily connected to the connection ports 204 of manifold 202 in an easy, one-step connection.

The core module 200 may be connected to an ink jet printer 8 (as schematically shown in FIG. 1) as follows. The printer connector 220 is connected to the manifold 202 to provide fluid communication of ink between the module components and the ink jet printer 8. An electrical connection (not shown) between the module 200 and the ink jet printer 8 may also be provided. The electrical connection may be any suitable connection, but preferably includes electrical wires with a socket connection. The ink jet printer 8 may include a receiving bay (not shown) disposed in cabinet 13. The core module 200 may be disposed in the receiving bay of the cabinet 13 while the printer is in use.

In particular, in one embodiment, the core module 200 is capable of being operably connected to the ink jet printer 8, to provide ink filtration and a fluid reservoir for the ink jet printer 8, in no more than three steps. The three steps include disposing the module 200 adjacent to the printer 8 (such as within the printer cabinet 13); providing an electrical connection between the module 200 and the printer 8; and connecting the connector 220 to the manifold 202. The electrical connection may include a plurality of wires with a socket connection between the printer 8 and the core module 200, thus providing all electrical connections within a single connection.

The fluid communication into and out of the module 200 between the ink circuit and the ink jet printer 8 may be solely provided through the plurality of connection ports 204. In particular, the connection between manifold 202 and connector 220 provides all the fluid communication between module 200 and ink jet printer 8, without the need for additional connections. This arrangement greatly simplifies the process of installing and replacing the module 200, as only one point of connection for all fluid lines is necessary.

The configuration of the manifold block and in particular the channels defined at the interface between the manifold plate and the feed plate obviates the need for many pipes, tubes, hoses or the like that interconnect the components of the ink supply system. The arrangement is thus much simpler to assemble thus reducing the time associated with building the system and the likelihood of errors occurring. In general, the area inside the cabinet is much tidier such that it is easier to access individual components. The manifold block also eliminates connectors associated with such pipes, which are potential sources of leaks. The reliability of the system is therefore improved thus reducing servicing requirements. Additionally, the configuration of printer connector 220 and connection manifold 202 allows for easy replacement of the core module 200 during servicing.

It will be appreciated that numerous modifications to the above described embodiment may be made without departing from the scope of the invention as defined in the appended claims. For example, the exact size and arrangement of channels in the plates may vary depending on the layout of the ink supply circuit. Moreover, not necessarily all of the components used in the ink supply circuit need be connected directly to the manifold block. It will also be appreciated that the channels in the plates of the manifold block can be used in other applications where a fluid circuit for interconnecting fluid-handling components is required. Further, the configuration of printer connector 220 and connection manifold 202 may be varied.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A method of connecting a core module to an ink jet printer, comprising:

providing an ink jet printer comprising a printer connector for supplying ink to the ink jet printer;

providing a core module comprising:

a housing;

a connection manifold disposed on the housing and comprising a plurality of ports providing fluid communication into and out of the module;

a filter module disposed within the housing, the filter module comprising a fluid filter disposed in a filter housing;

an ink reservoir disposed within the housing; and an ink circuit in fluid communication with the connection manifold, the ink reservoir, the filter module and the ports; and connecting the printer connector to the connection manifold to provide fluid communication of ink between the core module and the ink jet printer.

2. The method of claim 1 further comprising providing an electrical connection between the core module and the ink jet printer.

3. The method of claim 1 wherein the core module is capable of being operably connected to the ink jet printer, to provide ink filtration and a fluid reservoir for the ink jet printer, in no more than three steps, the three steps comprising:

a step of disposing the core module adjacent to the printer;

a step of providing an electrical connection between the module and the ink jet printer; and the step of connecting the printer connector to the manifold.

4. The method of claim 3 wherein the core module supplies ink through the connection manifold to a print head of the ink jet printer.

5. The method of claim 3 wherein the core module receives ink and solvent through the connection manifold.

6. The method of claim 1 wherein the core module further comprises a pump for conveying fluid through the ink circuit.

7. The method of claim 1 wherein fluid communication into and out of the core module between the ink circuit and the ink jet printer is solely provided through the plurality of ports.

8. The method of claim 1 wherein the fluid filter is an ink filter, wherein the core module further comprises a solvent filter, and wherein the printer connector and connection manifold provide fluid communication of solvent between the ink jet printer and the solvent filter.

9. A core module for an ink jet printer, the core module comprising:

a housing;

a connection manifold disposed on the housing and comprising a plurality of ports providing fluid communication into and out of the core module;

a plurality of components disposed within the housing, comprising:

a filter module, the filter module comprising a fluid filter disposed in a filter housing, the filter housing having an inlet and an outlet; and an ink reservoir; and an ink circuit in fluid communication with the components and the ports, and comprising fluid paths for conveying ink between the components;

the filter module being connected to the connection manifold such that the filter housing inlet and outlet are each in fluid communication with one of the plurality of ports on the connection manifold.

10. The core module of claim 9 wherein the plurality of components further comprises a pump for conveying fluid through the ink circuit.

11. The core module of claim 9 wherein fluid communication of ink into and out of the core module between the ink circuit and the printer is solely provided through the plurality of ports.

12. The core module of claim 9 wherein all of the plurality of ports are disposed on a single surface of the housing.

13. The core module of claim 9 wherein the connection manifold is a first connection manifold and the ink jet printer comprises a second connection manifold, the first connection manifold configured such that the plurality of ports may be connected to the second connection manifold in a single connection to provide fluid communication between the ink jet printer and the ink circuit.

14. The core module of claim 9 wherein the filter module is supported above the ink reservoir.

15. The core module of claim 9 wherein at least one of the inlet and the outlet of the filter housing is releasably engaged with a wall that defines, at least in part, one of the plurality of ports.

16. The core module of claim 9 wherein the fluid filter is an ink filter, further comprising a solvent filter.

17. The core module of claim 9 wherein the components include at least one transducer for sensing characteristics of the ink.

18. The core module of claim 9 wherein the components include a fluid damper for damping pressure pulsation in the ink circuit.

19. A continuous ink jet printer comprising a print head and an ink supply system for supplying ink to the print head, the ink supply system comprising a core module that comprises:

a housing;

a connection manifold disposed on the housing and comprising a plurality of ports providing fluid communication into and out of the core module;

a plurality of components disposed within the housing, comprising:

an ink filter module, the filter module comprising a fluid filter disposed in a filter housing, the filter housing having an inlet and an outlet; and an ink reservoir;

the ink filter being supported above the ink reservoir;

the ink supply system further comprising an ink circuit in fluid communication with the components and the ports, and comprising fluid paths for conveying ink between the components;

the ink filter module being connected to the connection manifold such that the filter housing inlet and outlet are each in fluid communication with one of the plurality of ports on the connection manifold.

20. A continuous ink jet printer according to claim 19, wherein the print head comprises an ink drop generator having a nozzle for breaking a continuous stream of ink into individual drops, a charge electrode for selectively applying a predetermined charge to the drops and a pair of deflection plates that provide an electric field for deflecting the charged drops.

21. A continuous ink jet printer according to claim 20, further comprising a gutter for collecting undeflected drops.

22. A continuous ink jet printer according to claim 19 wherein the plurality of components further comprises a pump for conveying fluid through the ink circuit.

23. A continuous ink jet printer according to claim 19, wherein all of the plurality of ports are disposed on a single surface of the housing.

* * * * *